US006270405B1

(12) United States Patent
Ferguson

(10) Patent No.: US 6,270,405 B1
(45) Date of Patent: Aug. 7, 2001

(54) CASINO POKER GAME AND METHOD

(76) Inventor: Dan Ferguson, 3939 W. 72nd Ave., Westminster, CO (US) 80030

( * ) Notice: Subject to any disclaimer, the term of this patent is extended or adjusted under 35 U.S.C. 154(b) by 0 days.

(21) Appl. No.: 09/315,253

(22) Filed: May 20, 1999

(51) Int. Cl.[7] ..... A63F 9/22

(52) U.S. Cl. ..... 463/13; 463/22; 273/138.1; 273/139; 273/274

(58) Field of Search ..... 463/1, 11–13, 463/16, 21–23, 19, 20; 273/138.1, 139, 271–274, 148 R, 148 B, 292, 293

(56) References Cited

U.S. PATENT DOCUMENTS

| | | | | |
|---|---|---|---|---|
| 5,489,101 | | 2/1996 | Moody | 273/292 |
| 5,531,440 | | 7/1996 | Dabrowski et al. | 463/12 |
| 5,531,441 | | 7/1996 | Dabrowski et al. | 463/12 |
| 5,531,448 | | 7/1996 | Moody | 273/292 |
| 5,542,669 | | 8/1996 | Charron et al. | 463/13 |
| 5,569,082 | | 10/1996 | Kaye | 463/17 |
| 5,586,766 | | 12/1996 | Forte et al. | 273/309 |
| 5,591,081 | | 1/1997 | Suzuki | 463/13 |
| 5,601,488 | | 2/1997 | Kadlic | 463/13 |
| 5,605,504 | | 2/1997 | Huang | 463/22 |
| 5,630,753 | | 5/1997 | Fuchs | 463/9 |
| 5,636,843 | | 6/1997 | Roberts | 273/292 |
| 5,639,088 | | 6/1997 | Schneider et al. | 273/138.2 |
| 5,669,817 | | 9/1997 | Tarantino | 463/13 |
| 5,685,774 | | 11/1997 | Webb | 463/13 |
| 5,732,950 | * | 3/1998 | Moody | 273/292 |
| 5,743,800 | | 4/1998 | Huard et al. | 463/26 |
| 5,755,621 | | 5/1998 | Marks et al. | 463/42 |
| 5,772,506 | | 6/1998 | Marks et al. | 463/13 |
| 5,775,992 | | 7/1998 | Wood et al. | 463/13 |
| 5,785,593 | | 7/1998 | Wood et al. | 463/13 |
| 5,794,964 | | 8/1998 | Jones et al. | 273/309 |
| 5,795,225 | | 8/1998 | Jones et al. | 463/13 |
| 5,803,809 | | 9/1998 | Yoseloff | 463/13 |
| 5,806,855 | | 9/1998 | Cherry | 273/292 |
| 5,810,663 | | 9/1998 | Bochichio et al. | 463/13 |
| 5,816,914 | | 10/1998 | Wichinsky | 463/13 |
| 5,816,915 | * | 10/1998 | Kadlic | 463/13 |
| 5,816,916 | | 10/1998 | Moody | 463/13 |
| 5,820,460 | | 10/1998 | Fulton | 463/13 |
| 5,820,461 | | 10/1998 | Pernatozzi | 463/16 |
| 5,823,873 | | 10/1998 | Moody | 463/13 |
| 5,833,536 | * | 11/1998 | Davids et al. | 463/11 |
| 5,839,731 | | 11/1998 | Feola | 273/292 |

(List continued on next page.)

FOREIGN PATENT DOCUMENTS

WO 98/14250 4/1998 (WO) ..... A63F/9/24

OTHER PUBLICATIONS

Advertising brochure for Game King "Triple Play Draw Poker," 1998.

* cited by examiner

*Primary Examiner*—Mark Sager
*Assistant Examiner*—John M Hotaling, II
(74) *Attorney, Agent, or Firm*—Greenlee, Winner and Sullivan, P.C.

(57) ABSTRACT

A method of simultaneously playing multiple hands of a poker game dealt from a single deck is provided. The player places an initial wager, and three to five cards are initially dealt from the deck into a first hand. The player may hold the cards in the first hand or move cards from the first hand into second, or third or subsequent hands. After the player moves each card from the first hand, a new card is dealt from the deck into the vacant position left in the first hand. When all the cards in the first hand have been held or moved into vacant positions in the second, third or subsequent hands, cards are dealt from the deck to fill in the remaining vacant positions in all the hands. The value of the poker hands is determined, and the player paid off in accordance with a predetermined payoff schedule. A casino-style electronic game implementing this method is also provided.

20 Claims, 10 Drawing Sheets

U.S. PATENT DOCUMENTS

| | | | | |
|---|---|---|---|---|
| 5,851,011 | | 12/1998 | Lott | 273/292 |
| 5,851,147 | | 12/1998 | Stupak et al. | 463/13 |
| 5,853,325 | | 12/1998 | Kadlic | 463/13 |
| 5,868,618 | | 2/1999 | Netley et al. | 463/13 |
| 5,868,619 | * | 2/1999 | Wood et al. | 463/13 |
| 5,882,259 | | 3/1999 | Holmes, Jr. et al. | 463/13 |
| 5,882,260 | | 3/1999 | Marks et al. | 463/13 |
| 6,098,985 | * | 8/2000 | Moody | 273/292 |
| 6,132,311 | * | 10/2000 | Williams | 463/13 |
| 6,135,882 | * | 10/2000 | Kadlic | 463/13 |
| 6,146,271 | * | 11/2000 | Kadlic | 463/13 |
| 6,149,157 | * | 11/2000 | Suan | 273/292 |

CASINO POKER GAME AND METHOD

BACKGROUND

Poker is a favorite gambling game widely enjoyed and understood by generations of players. The rules are simple; payoffs are relatively immediate, and both skill and luck are rewarded. The game has been adapted to electronic casino-style gaming machines where it has enjoyed a fair degree of success; however, games now known to the art either minimize the extent to which the player can win by using skill and inflate the effects of random chance, making such games less attractive to experienced poker players than would be desirable, or maximize the effects of skill so that the inexperienced player had little chance to win and little incentive to keep playing. To attract the greatest number of players, a poker game should allow and reward skill, but should also allow an unskilled player to rely on luck for winnings.

U.S. Pat. No. 5,868,619 to Wood et al. issued Feb. 9, 1999 for "Method for Playing a Poker Game" discloses a game machine using a 52-card deck to deal an initial five-card hand to a player. The player makes an initial wager. The player may then divide the cards dealt into one to five subhands by moving cards in any desired order, and moving several cards into the same subhand if desired. The game device allocates an amount of the initial wager to each subhand based on the number of cards moved into it. The game device then randomly fills out the subhands and pays the player in accordance with the value of the hands. This device does not require or allow the player to make decisions about moving cards after additional cards have been dealt, thus limiting the amount of skill the player can use.

U.S. Pat. No. 5,823,873 issued Oct. 20, 1998 to Moody for "Method of Playing Electronic Video Poker Games" discloses a game in which at least two rows of cards, preferably three, are used and the player can wager on each row. Cards are dealt into a first row. The player chooses cards to hold from the first row, and these are duplicated into the other rows. Cards are then dealt at random to fill the rows and the poker hand ranking of the rows is determined. The fact that cards are duplicated such that a regular 52-card deck is not used interferes with the player's skill and ability to anticipate what poker hands can be formed.

U.S. Pat. No. 5,882,260 issued Mar. 16, 1999 to Marks, et al. for "Modified Poker Card Game and Computer System for Implementing Same," discloses a poker game in which the player is allowed to place each dealt card in a pattern of intersecting hands and the value of the resulting hands is determined. This game makes no provision for the unskilled player to rely on chance to determine the placement of his cards.

A number of patents allow the player to play only a single hand at one time, which, in providing fewer ways to win, is less attractive to most players. U.S. Pat. No. 5,816,916 issued Oct. 6, 1998 to Moody provides a game in which only a single hand is dealt, but cards with matching values are stacked and replacement cards dealt. The value of the hand is determined using all the cards shown on the display screen. U.S. Pat. No. 5,542,669 issued Aug. 6, 1996 to Charron et al. for "Method and Apparatus for Randomly Increasing the Payback in a Video Gaming Apparatus," U.S. Pat. No. 5,605,504 issued Feb. 25, 1997 to Huang for "Electronic Wagering Machine," U.S. Pat. No. 5,636,843 issued Jun. 10, 1997 to Roberts for "Methods for Prop Bets for Blackjack and Other Games," U.S. Pat. No. 5,772,506 issued Jun. 30, 1998 to Marks et al. for "Video Poker Gold Card Game and Computer System for Implementing Same," U.S. Pat. No. 5,785,593 issued Jul. 28, 1998 to Wood et al. for "Method of Playing a Poker Game," U.S. Pat. No. 5,820,460 to Fulton for "Method of Playing a Poker-Type Game and Apparatus Therefor," U.S. Pat. No. 5,851,145 issued Dec. 22, 1998 to Stupak et al. for "Player-Selected Variable Jackpot Gaming Method and Device," U.S. Pat. No. 5,851,011 issued Dec. 22, 1998 to Lott for "Multi-Deck Poker Progressive Wagering System with Multiple Winners and Including Jackpot, Bust, and Insurance Options," and U.S. Pat. No. 5,882,259 issued Mar. 16, 1999 to Holmes, Jr. et al. for "Method of Playing an Electronic Video Card Game" disclose single-hand games. U.S. Pat. No. 5,816,915 issued Oct. 6, 1998 to Kadlic for "Pick One Poker Method of Play" discloses a game dealing five hands, however, the player picks only a single hand to play.

The same undesirable feature of not providing multiple hands to the player to play simultaneously is shared by U.S. Pat. No. 5,489,101 issued Feb. 6, 1996 to Moody for "Poker Style Game" which discloses a game requiring a player and a dealer. U.S. Pat. No. 5,816,9124 issued Oct. 6, 1998 to Wichinsky for "Method of Playing a Stud Poker Game," discloses a game requiring two hands, but only one of these is for the player; the other is the dealer's hand. U.S. Pat. No. 5,755,621 issued May 26, 1998 to Marks et al. for "Modified Poker Card/Toumament Game and Interactive Network Computer System for Implementing Same" also discloses a game requiring more than one player.

Other patents disclose the use of multiple decks, thus limiting the player's use of skill in predicting cards likely to be dealt. These include U.S. Pat. No. 5,531,440 and 5,531,441 issued Jul. 2, 1996 to Dabrowski et al. for "Double Poker," U.S. Pat. No. 5,775,992 issued Jul. 7, 1998 to Wood et al. for "Method of Playing," U.S. Pat. No. 5,803,809 issued Sep. 8, 1998 to Yoseloff for "Method of Playing a Multi-Decked Poker Type Game," and U.S. Pat. No. 5,868,618 issued Feb. 9, 1999 to Netley et al. for Poker Game Method. In addition, Game King Product Brochure entitled "Triple Play Draw Poker" discloses a game using multiple hands, each hand drawn from a separate 52-card deck.

Multiple playoffs are disclosed in U.S. Pat. No. 5,639,088 issued Jun. 17, 1997 to Schneider et al. for Multiple Events Award System" which provides a system whereby awards are provided to a player over multiple rounds of a game.

The use of multiple hands is disclosed in U.S. Pat. No. 5,806,855 issued Sep. 15, 1998 to Cherry for "Poker Wagering Game," however cards may not be moved between hands. U.S. Pat. No. 5,839,731 issued Nov. 24, 1998 to Feola for "Method and Apparatus for Playing a Casino Game" also discloses the use of multiple hands but does not provide for moving cards between hands.

Other casino games having electronic features include those disclosed in U.S. Pat. No. 5,586,766 issued Dec. 24, 1996 to Forte et al. for "Blackjack Game System and Methods," U.S. Pat. No. 5,669,817 issued Sep. 23, 1997 to Tarantino for "Casino Card Table with Video Display," U.S. Pat. No. 5,794,964 issued Aug. 18, 1998 to Jones et al. for "Apparatus for Progressive Jackpot Gaming," U.S. Pat. No. 5,795,225 issued Aug. 18, 1998 to Jones et al. for "Methods of Progressive Jackpot Gaming," U.S. Pat. No. 5,531,448 issued Jul. 2, 1996 to Moody for "Poker-Style Card Game" which deals with a combined game of twenty-one and stud poker, U.S. Pat. No. 5,569,082 issued Oct. 29, 1996 to Kaye for "Personal Computer Lottery Game," U.S. Pat. No. 5,591,081 issued Jan. 7, 1997 to Suzuki for "Card Game Amusement Device," U.S. Pat. No. 5,601,488 issued Feb.

11, 1997 to Kadlic for "Electronic Rummy Game," U.S. Pat. No. 5,630,753 issued May 20, 1997 to Fuchs for "Gaming Machine," U.S. Pat. No. 5,685,774 issued Nov. 11, 1997 to Webb for "Method of Playing Card Games," U.S. Pat. No. 5,743,800 issued Apr. 28, 1998 to Huard et al. for "Auxiliary Game with Random Prize Generation," U.S. Pat. No. 5,820,461 issued Oct. 13, 1998 to Pernatozzi for "Game for a Casino," and U.S. Pat. No. 5,853,325 issued Dec. 29, 1998 to Kadlic for "Method of Playing an Electronic Runmmy Game Apparatus."

A game is needed which will provide a single player with the ability to play multiple hands dealt from a single deck simultaneously, and which provides an attractive balance of rewards for both skill and luck by allowing the player to move cards between hands after the additional cards have been dealt.

SUMMARY OF THE INVENTION

A method of simultaneously playing multiple hands of a poker game is provided. Three hands or five hands are preferred, and in addition, secondary hands may be compiled from selected cards in the three or five primary hands. The game is played using a single deck of cards comprising 52 cards, and optionally additional wild cards such as two jokers. Cards discarded from the first or primary hand dealt are used by the player to build other hands.

The game may be played with actual cards or with virtual cards using a programmed electronic game, preferably a casino-style game providing slots, magnetic card readers or other means for inserting money, chips, or credit numbers to activate the game and means for paying out winnings as are known to the art. The steps in the method of playing this game are performed either by the player or by a dealer or programmed electronic game machine in response to the player's actions.

The game comprises providing positions for placement of cards in a plurality of poker hands; placing a wager on each poker hand or on the aggregate of said plurality of poker hands; randomizing a card deck as by shuffling or running a randomizing algorithm in a processor of a video game to provide cards in a random order; dealing an initial three to seven cards, e.g., tree, five or seven, into a first hand from said randomized deck; holding or moving each card dealt into said first hand into positions provided for one more additional five-card hands; dealing from said randomized deck an immediate replacement card into said first hand for each card moved; and when all cards in said first hand have been held or have been moved into unfilled spaces in said additional hands, dealing cards from said randomized deck in a preset pattern to fill in all remaining available positions and complete said poker hands; followed by determining the value of each poker hand and paying to or receiving from the player the value of each poker hand in accordance with predetermined payoff amounts.

DETAILED DESCRIPTION

Figure 1A:
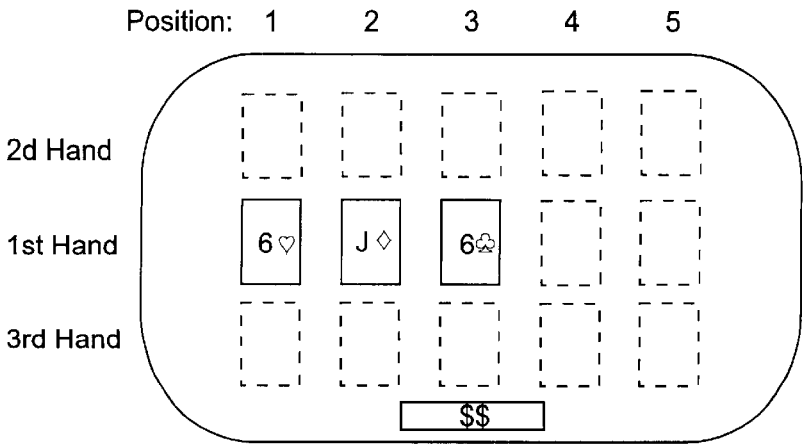
FIGS. 1A through 1H show play of the poker game of this invention in "shotgun" method using three hands with an initial deal of three cards into the first (middle) row, showing the player's decisions to successively hold or move cards from the first row into corresponding positions in the second (top) or third (bottom) rows.

The poker game of this invention is preferably played with the object of building standard winning poker hands such as royal flush (ten, jack, queen, king and ace of the same suit), straight flush (five sequential cards of the same suit), four of a kind (four cards of the same number), three of a kind (three cards of the same number) two of a kind (two cards of the same number), full house (three of a kind plus two of a kind) flush (five cards of the same suit), straight (five sequential cards, not of the same suit), two pairs (of cards having the same number), and pairs of jacks, queens, kings or aces. Payoffs can also be set to reward other combinations. Since the game provides for play of multiple hands, obtaining two or more of the same winning hand can be rewarded with bonus payoffs.

Positions for placement of cards in each of the hands dealt are provided, either on a flat surface such as a table top, or on a display screen of a video game machine. In the video game machine, vacant positions are preferably indicated by card-shaped blanks. In the description that follows, the middle hand is referred to as the "first hand." In the three-hand layout as shown in FIG. 1, containing three horizontal rows, the top hand is referred to as the "second hand" and the bottom hand is referred to as the "third hand." In the five-card layout, the cards may be laid out in five horizontal rows, or in three rows with the top and bottom rows containing two five-card hands as shown in FIG. 3. The topmost row or, in the layout of FIG. 3 the top left hand, is referred to as the "second hand," the second row or, in the layout of FIG. 3 the top right hand, is referred to as the "third hand," the bottom row or the right bottom hand is referred to as the "fifth hand" and the second from the bottom row or, in the layout of FIG. 3, the left bottom hand is referred to as the "fourth hand." The card positions of each hand are referred to herein as first, second, third, fourth and fifth from left to right.

The player may place a wager on the outcome of each hand or on the total (aggregate) value of all the hands either at the beginning or during play, or both. For example, the player may wager a set number of coins to begin the game, and may add to or change his wager after the first, second, third, fourth or fifth positions have been played as described below. The wagers may be made by inputting into a video game device.

The deck of cards is randomized by shuffling by a dealer or by means of an algorithm in the processor of the game machine to present cards in random order. The dealer then deals an initial three to five cards into positions provided for the first hand from the randomized deck, or the electronic game machine provides card images from said deck into said position. The term "deal" as used herein refers both to dealing actual cards and to providing virtual card images on a display screen.

The player may then decide to hold or move each of the cards dealt into the first hand into positions provided for the other hands. As soon as a card is moved, a replacement card is immediately dealt to fill the vacant position in the first hand. When all vacant positions are filled, the player can no longer move cards out of the first hand, or when the player indicates he wishes to hold cards in the first hand, the held cards can no longer be moved. When all the cards in the first hand can no longer be moved, any remaining vacant positions in the other hands are filled in by dealing from the randomized deck to complete the hands. The dealing is done in preset order, e.g. by filling in vacant positions and hands in sequential order, or by filling in corresponding positions of all hands in sequential order before moving onto the next position in all the hands, or in any other desired preset order.

The value of each poker hand is then determined using payoff tables as described below or other payoff tables as may be set by the house. As is known to the art, the percentage retained by casinos may be regulated by law. In addition, tables providing optimum player return, hit frequency (frequency of obtaining a reward), and other payoff statistics may be published, posted or displayed on casino games as an incentive to players. The payoff amounts may be calculated by algorithms known to the art to provide payoffs which are within the legally set limits and are also attractive to players. In a preferred embodiment using a casino-style electronic game machine, the payoff amounts may be adjustable.

When the game is over, the payer may be paid off or required to pay amounts in accordance with the value of the completed hands. In a preferred embodiment using an electronic game machine, an initial amount is input by the player to begin play and the machine calculates and displays the amount of money remaining including any winnings throughout a series of games until the player indicates he wishes to stop playing.

The game may be played "shotgun" style by dealing only three cards initially into the first hand, or normal style by dealing all five cards into the first hand.

In a preferred embodiment, the player must play the card in the first position of the first hand before being allowed to hold or move cards in subsequent positions. If the player decides to hold the card in the first position in the first hand, he may indicate this decision to the dealer, or in the case of an electronic game, may input a signal, such as by pressing a button, touching a spot on the screen, or answering "yes" to a displayed question. If he decides to move the card in the first position, he may move it only to the first position of another hand. He may manually move the card or provide a signal to the game machine as known to the art to cause the card image to move to the desired position. The dealer or game machine immediately deals a replacement card to fill the vacant first position of the first hand. The player may again decide to hold or move the replacement card into another vacant first position. When all vacant first positions in all the hands are filled or when the player has indicated his decision to hold the card in the first position of the first hand, play moves to the second position of the first hand.

Play of the second position of the first hand is completed as described above for the first position, and when all vacant second positions in all the hands are filled, or when the player has indicated his decision to hold the card in the second position of the first hand, play moves to the third position.

In the "shotgun" method where only three cards were initially dealt into the first hand, after the player has played the third position, cards may be dealt into the fourth and fifth positions of the first hand, and these positions sequentially played as above; or a card may be dealt into the fourth position of the first hand, and that position played completely before a card is dealt into the fifth position of the first hand. When the fifth position of the first hand has been played, cards are dealt from the randomized deck to fill in any remaining blank positions. When the game is played by the normal dealing method, with all five cards being initially dealt into the first hand, the five positions are sequentially played as described above.

Each hand layout comprising positions one through five is referred to herein as a "primary hand." In addition to determining the poker hand value of the primary hands at the completion of the game, poker hand values for secondary hands made up of selected cards from the primary hands may also be determined and used to calculate payoff amounts, for example as shown in FIG. 4.

FIG. 1A show a three hand embodiment of the poker game of this invention in which three cards are dealt in "shotgun" style, i.e. an initial deal of three cards is made into the first (middle) hand from a 52-card deck containing ace through king of four suits. The game may be played with actual cards, or with virtual cards in a video game device as shown, in which the 52 cards are randomized and dealt in random order. In the video game embodiment, positions or spaces for the card images are provided for three rows of five cards each. A screen display keeps a running tally of the player's winnings, preferably the number of coins available to wager.

The initial deal is activated by the player's placing an initial wager or otherwise signaling the game machine to start play, e.g. by inserting coins or chips into the machine. After the initial deal, the player may optionally make another wager on the value of the hands. Each time a new card is dealt, the player may also optionally make an additional wager on each band.

After the initial deal of three cards into the first (middle) hand, the player makes a decision to hold or move the card in the first position of the first hand. He may move the card to the corresponding (first) position of the second hand (the top row) or the corresponding (first) position of the third hand (the bottom row). In the embodiment shown, the player has decided to hold the card (the six of hearts) in the first position of the first hand. He may indicate this decision either by inputting a hold signal or by inputting a signal to move or hold the card in the second position of the first row. Once the card in the second position of the first hand is activated, the player can no longer move the card in the first position. Once a card has been moved into another hand from the first hand, that card cannot be moved again.

Figure 1B:
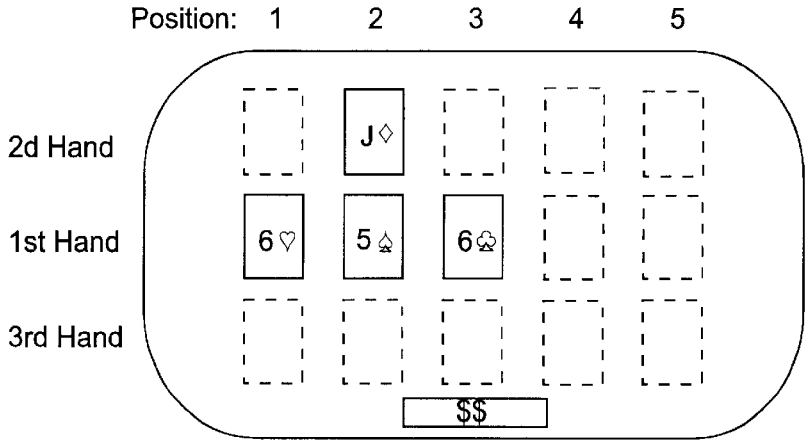
Figure 1C:
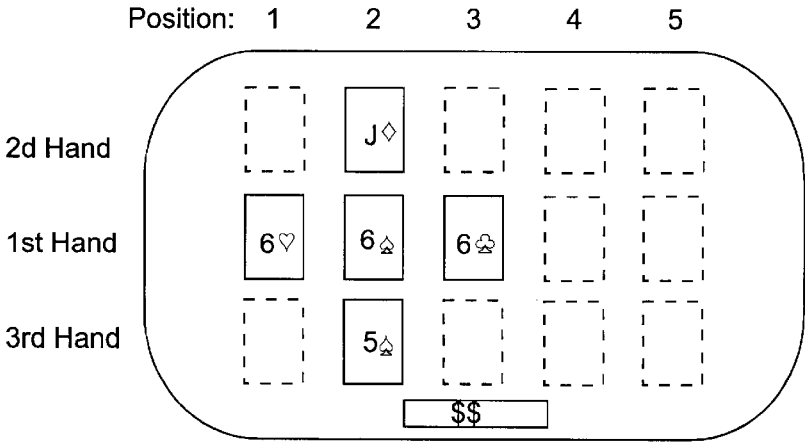

As shown in FIG. 1B, the player has decided to move the card in the second position of the first hand (the jack of diamonds) to the corresponding second position of the second hand. A replacement card (the five of spades) is then dealt into the vacant second position of the first hand. The player may at this point decide to hold the replacement card in the second position of the first hand or to move it to the vacant corresponding second position of the third hand. As shown in FIG. 1C, the player moves the card into the second position of the third hand and a second replacement card (the six of spades) is dealt into the second position of the first hand.

Figure 1D:
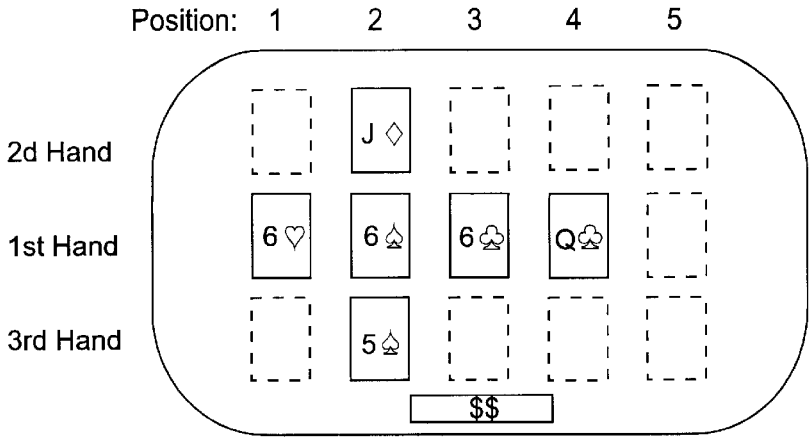
Figure 1E:
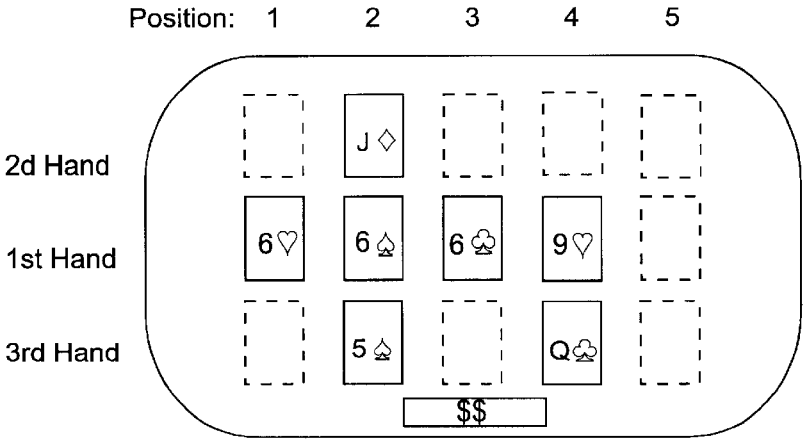

As all second positions in all three hands are now filled, the player is now able to decide to hold or move the card in the third position of the first hand (the six of clubs). As shown in FIG. 1D, the player decides to hold this card. He may indicate this decision by inputting a hold signal or by activating a deal signal to cause a card (the queen of clubs) to be dealt into the fourth position of the first hand. The player now decides whether to hold or move the card in the fourth position of the first hand and, as shown in FIG. 1E, decides to move the card to the corresponding fourth position of the third hand. A replacement card (the nine of hearts) is then dealt into the vacant fourth position of the first hand.

Figure 1F:
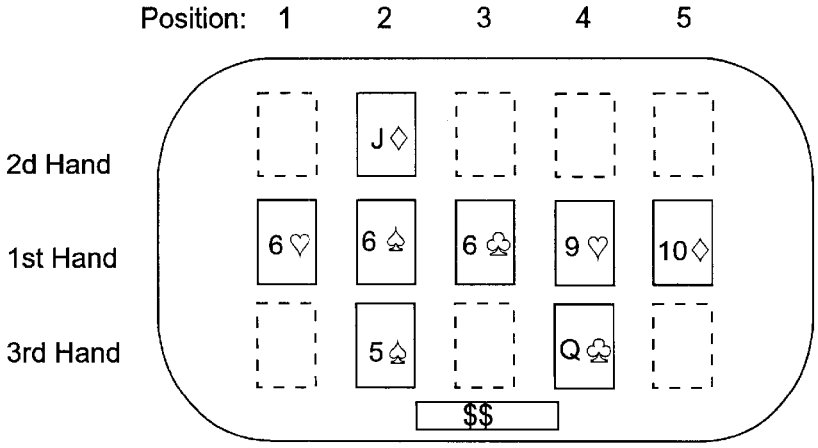
Figure 1G:
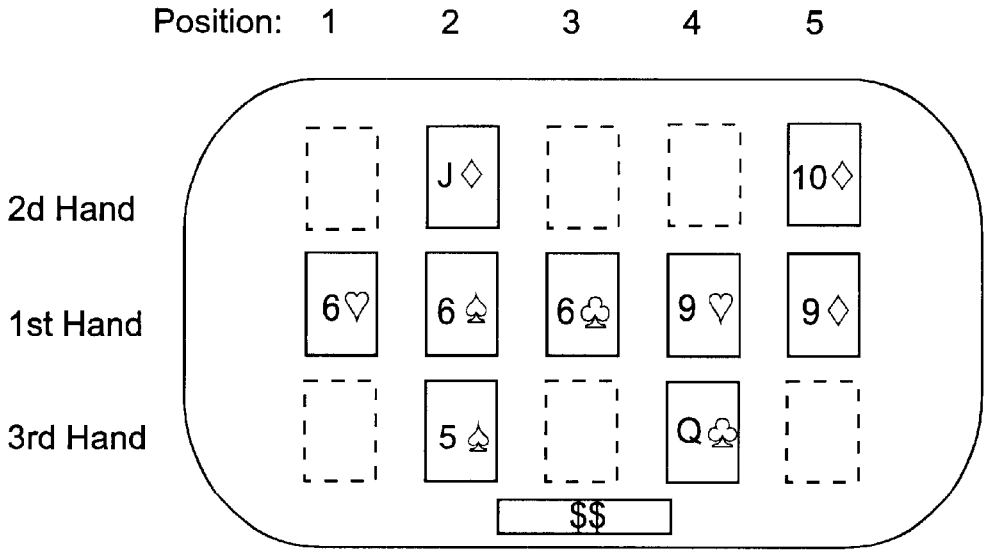
Figure 1H:
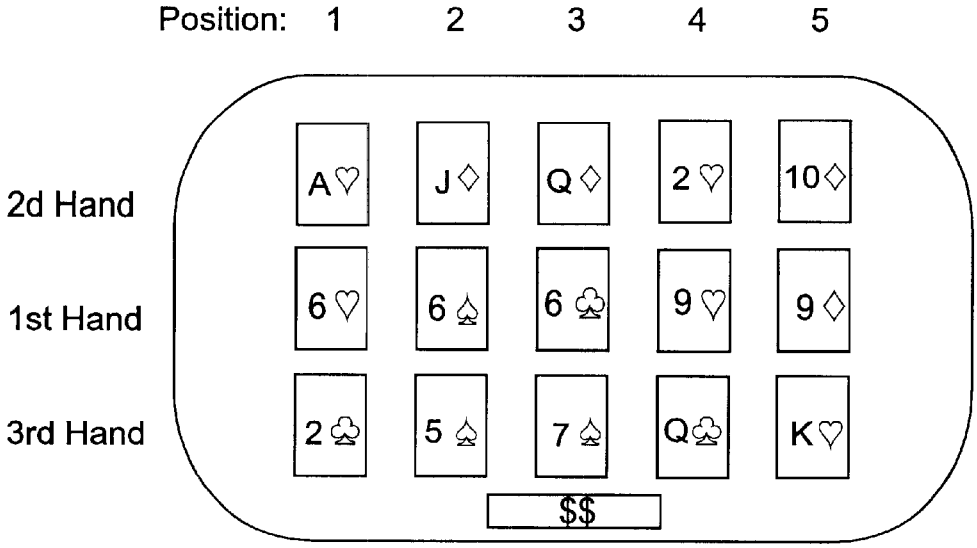

The player then either activates a hold signal or a deal signal to cause a card to be dealt into the fifth position of the first hand, as shown in FIG. 1F (the ten of diamonds). The player may then decide to move the card in the fifth position of the first hand into the corresponding vacant fifth position of the second or third hand. In the embodiment shown, the player decides to move this card into the fifth position of the second hand. A new card is then dealt into the fifth position of the first hand (the nine of diamonds) as shown in FIG. 1G. The player then decides to hold the card in the fifth position of the first hand by activating a hold signal or a deal signal, and the remaining vacant positions in all three hands are filled in by dealing from the 52-card randomized deck as shown in FIG. 1H. The cards may be filled in in any preprogrammed order, for example, the open positions in the second hand may be filled in sequentially, followed by sequentially filling in the open positions in the third hand; or cards may be alternately dealt into the next open position in the second or third hands, or in any other desired order.

The poker hand value of all three hands is then determined, and the player is paid off in accordance with a payoff schedule as described below.

When the game is played using a normal five-card deal into the first hand rather than using the "shotgun" method of dealing only three cards initially, the player makes his wagers as described above, and makes decisions to hold or move the cards in each position of the first hand sequentially. He is not allowed to move a card from the first hand until all possible vacant spaces in lower-numbered positions are filled in all the hands, or until he has signaled his decision to hold the cards in the lowernumbered positions of the first hand.

Figure 2A:
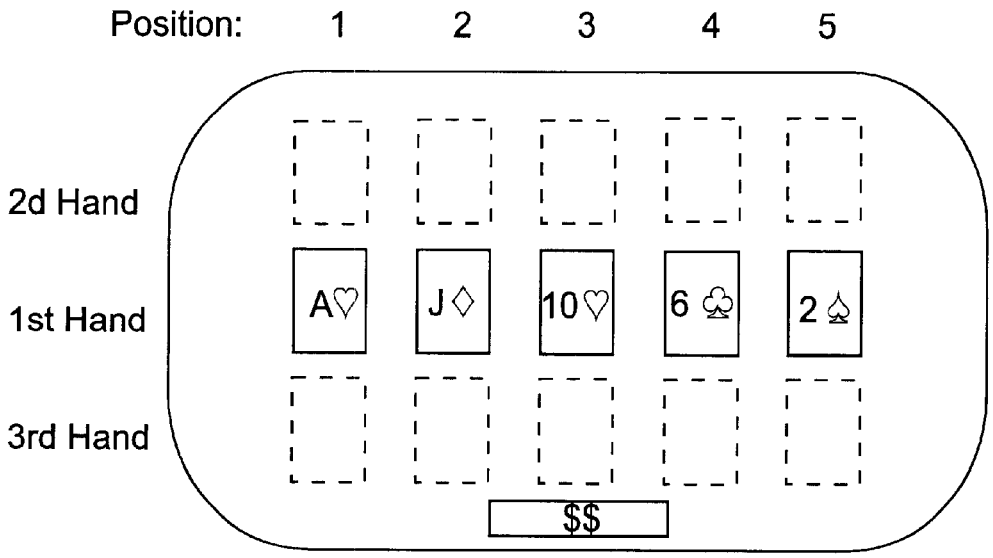
FIGS. 2A and 2B show play of the poker game of this invention in regular deal method using three hands, wherein the player has made a decision to hold all five cards initially dealt.
Figure 2B:
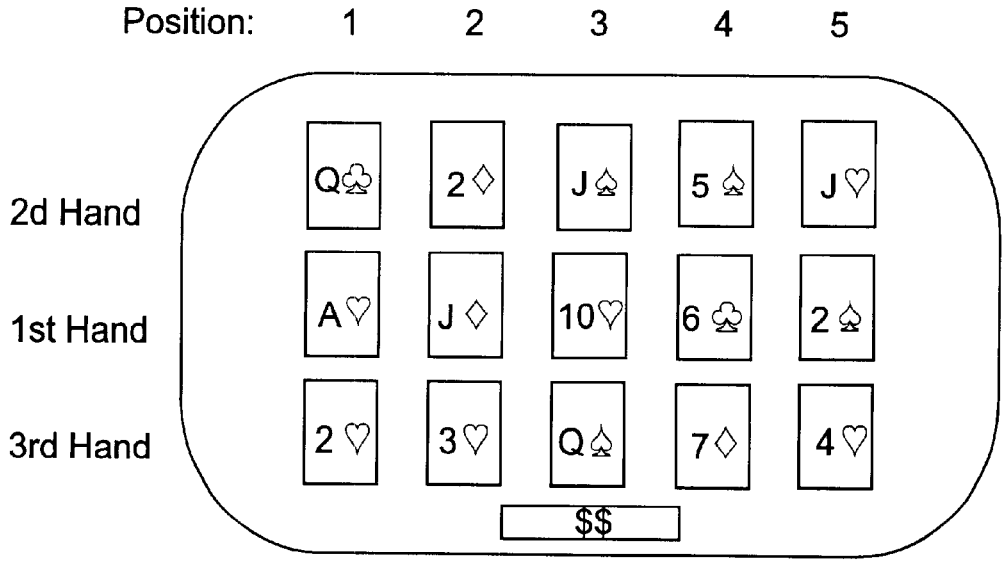

FIGS. 2A and 2B show the three-hand game using a normal five-card deal into the first hand. In this embodiment, five cards are dealt from a randomized 52-card deck into the first hand as shown in FIG. 2A. The player in this case has decided to hold all the cards in the first hand. Upon his signal indicating this decision, the remaining vacant spaces are filled with cards dealt from the same deck in any desired, preprogrammed order, as shown in FIG. 2B. The poker hand value of all three hands is then determined, and the player is paid off in accordance with a payoff chedule.

Figure 3A:
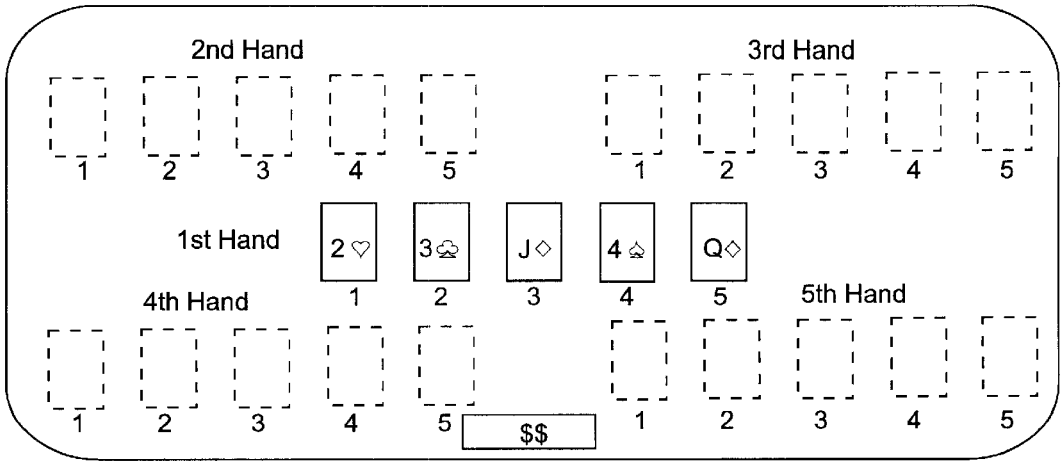
FIGS. 3A through 3K show play of the poker game in regular deal method using five hands.
Figure 3B:
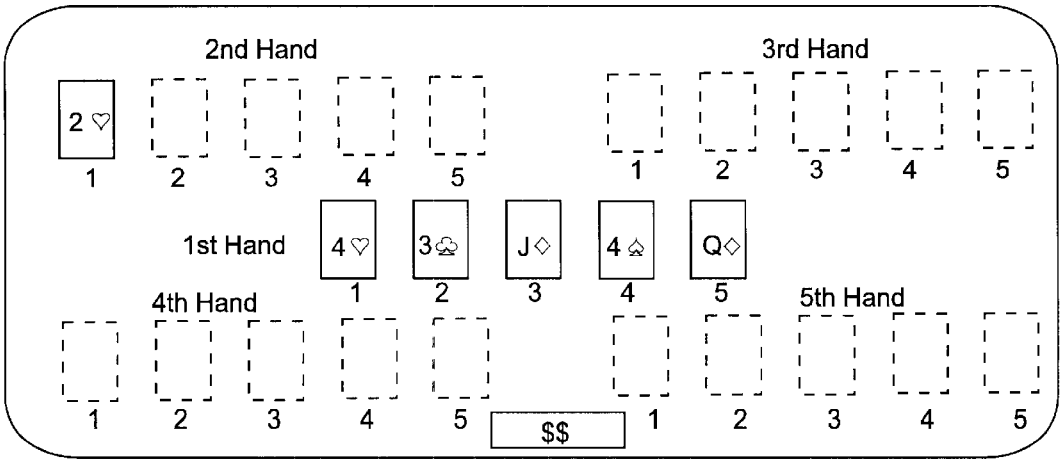
Figure 3C:
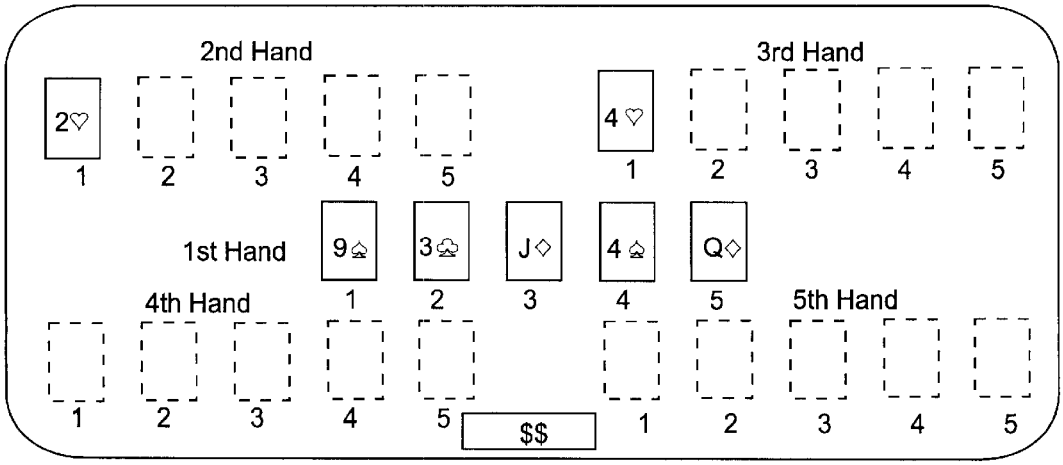

FIGS. 3A through 3K show the five-hand game of this invention using a normal deal method wherein five cards are initially dealt into the first (middle) hand as shown in FIG. 3A. The player makes his wagers on each hand as described above. FIG. 3B shows the player's decision to move the card in the first position of the first hand (the two of hearts) into the first position of the second hand (top left). A replacement card (the four of hearts) is immediately dealt from the 52-card randomized deck into the first position of the first hand. FIG. 3C shows the player's decision to move the replacement card from the first position of the first hand into the first position of the third (top right) hand. A replacement card (the nine of spades) immediately fills into the first position of the first hand. The player then decides to bold the second replacement card in the first position of the first hand, and play moves to the second position of the first hand.

Figure 3D:
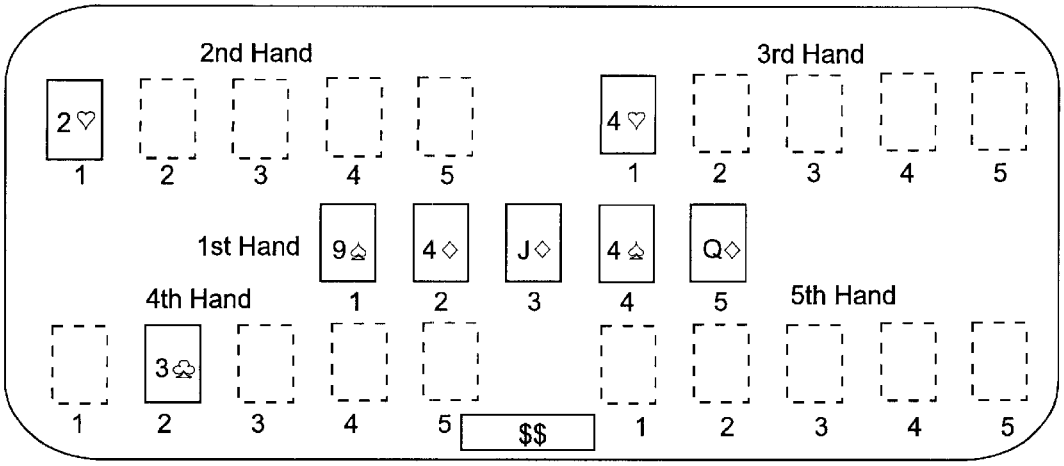
Figure 3E:
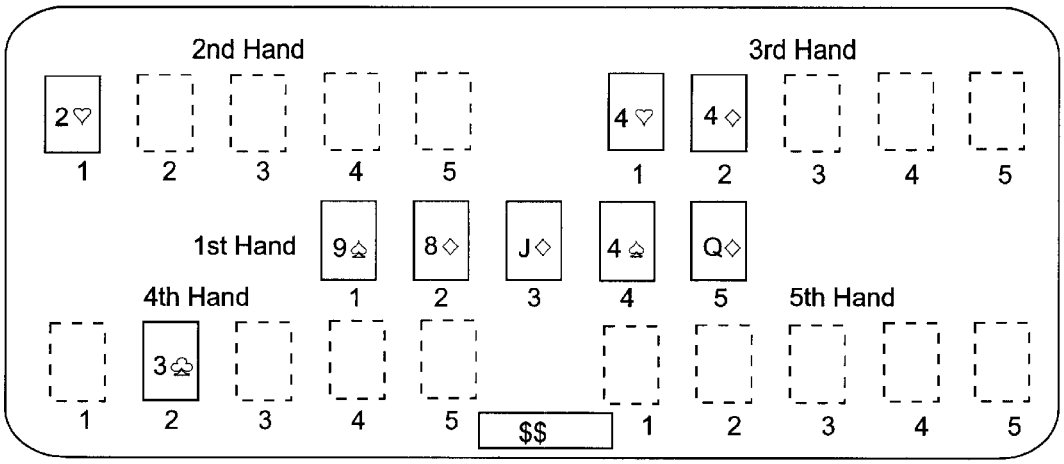
Figure 3F:
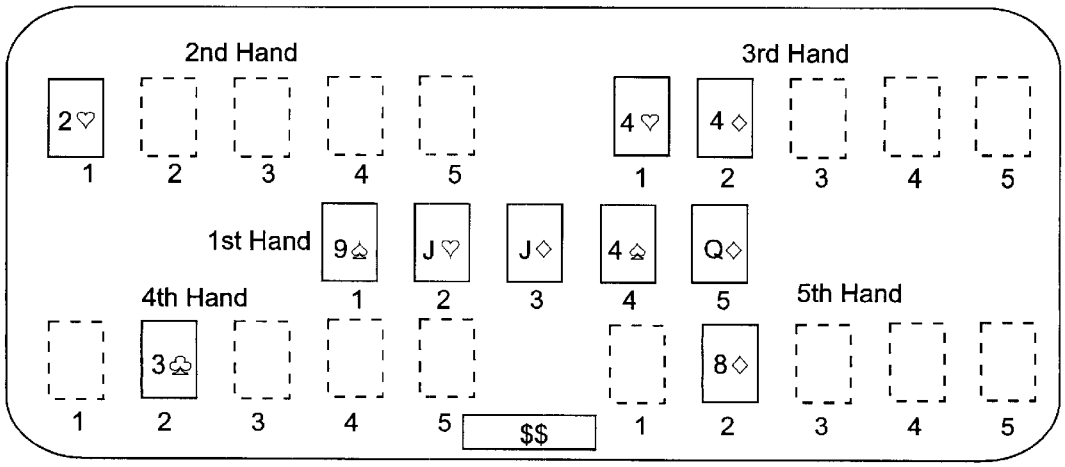

FIG. 3D shows the player's decision to move the card in the second position of the first hand (the three of clubs) into the second position of the fourth (bottom left) hand. A replacement card (the four of diamonds) then fills into the second position of the first hand. FIG. 3E shows the player's decision to move the replacement card from the second position of the first hand to the second position of the third hand. A second replacement card (the eight of diamonds) then fills into the second position of the first hand. FIG. 3F shows the player's decision to move the second replacement card to the second position of the fifth (bottom right) hand. A third replacement card (the jack of hearts) then fills into the second position of the first hand. The player decides to hold the third replacement card in the second position of the first hand, and play moves to the third position of the first hand.

Figure 3G:
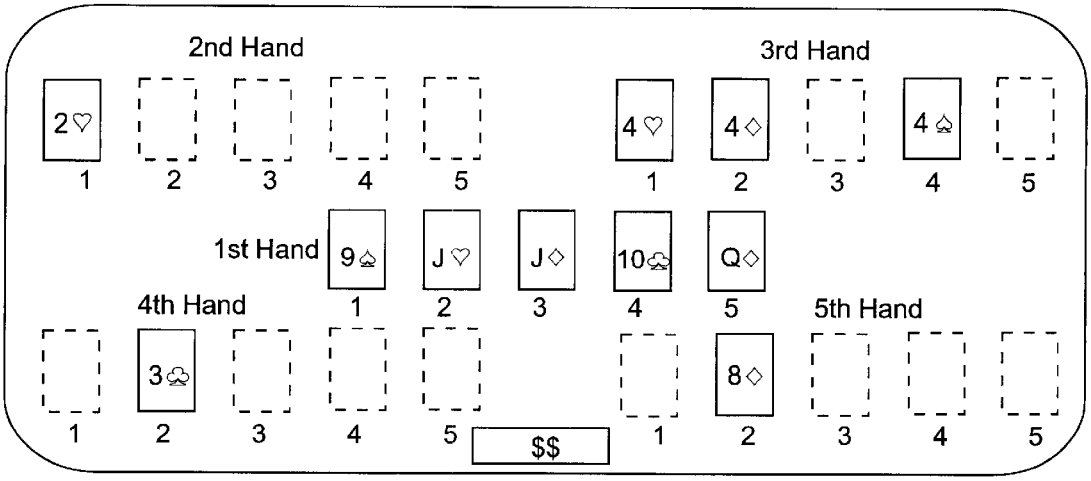
Figure 3H:
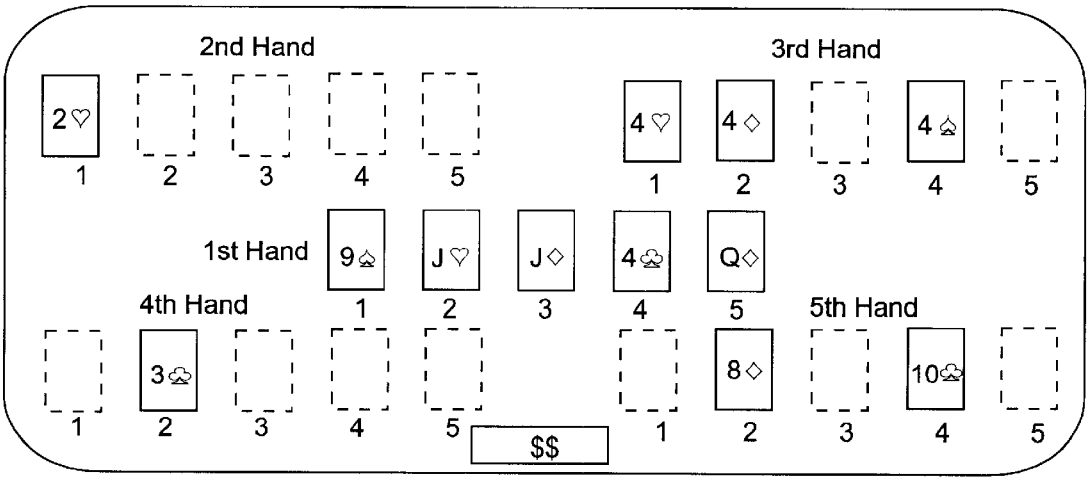
Figure 3I:
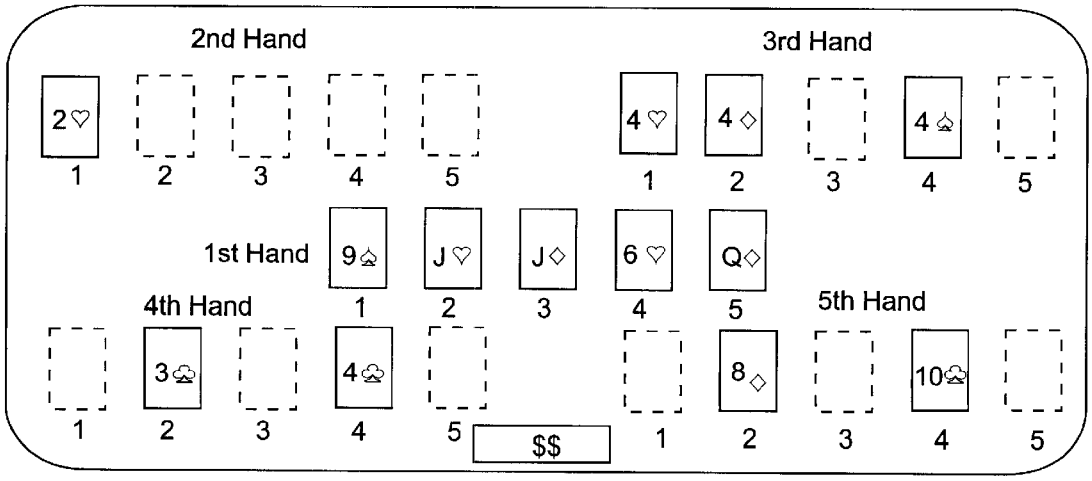
Figure 3J:
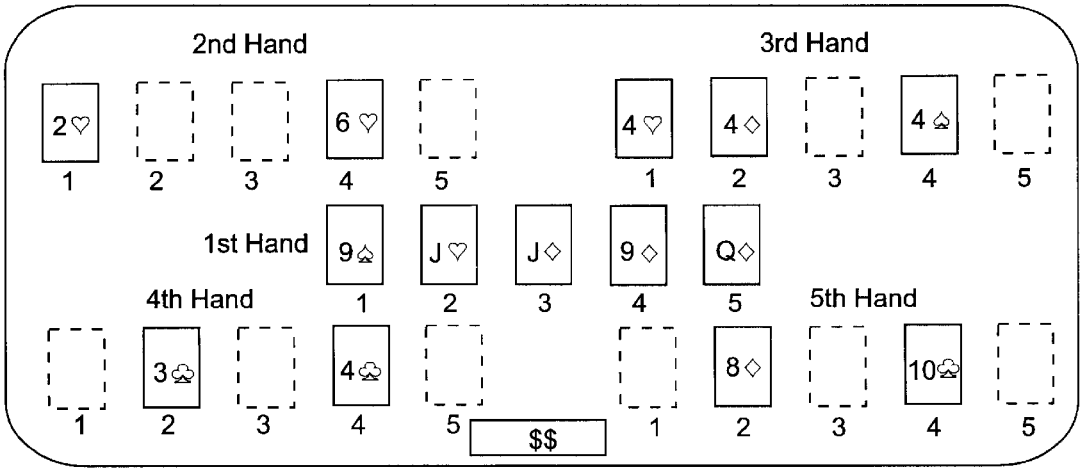

The player decides to hold the card in the third position of the first hand (the jack of diamonds as shown in FIG. 3F), and play moves to the fourth card in the first hand (the four of spades) which the player moves as shown in FIG. 3G to the fourth position of the second hand. A replacement card (the ten of clubs) then fills into the fourth position of the first hand. FIG. 3H shows the player's decision to move the replacement card from the fourth position of the first hand to the fourth position of the fifth hand, whereupon a second replacement card (the four of clubs) moves into the fourth position of the first hand. FIG. 3I shows the player's decision to move the second replacement card from the fourth position of the first hand to the fourth position of the fourth hand, whereupon it is replaced by a third replacement card (the six of hearts). FIG. 3J shows the player's decision to move the third replacement card from the fourth position of the first row to the fourth position of the second hand, whereupon it is replaced by a fourth replacement card (the nine of diamonds). At this point, all the blank fourth positions of all the hands have been filled and play moves to the fifth position of the first hand.

Figure 3K:
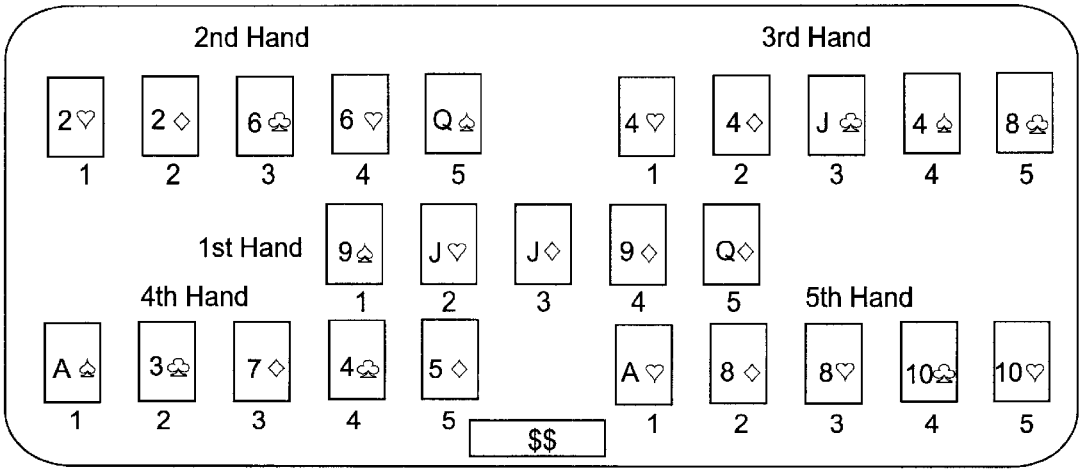

FIG. 3K shows that the player has decided to hold the card in the fifth position of the first hand (the queen of diamonds), whereupon, the remaining vacant spaces in all the hands are filled in in a pre-programmed order using cards from the 52-card deck. The value of all the hands is then determined, and the player paid off accordingly.

The five-hand game described above may also be played by "shotgun" method in which three cards are initially dealt into the first hand, and when play moves to the fourth position of the first hand, a new card is dealt into that position, followed by the player's decisions to hold or move the card in the fourth position, the dealing of replacement cards into the fourth position as necessary, and when play is completed in the fourth position, a new card is dealt into the fifth position of the first hand and again the player makes his decisions to hold or move cards from that position. When all fifth positions are filled, or the player has decided to hold any card or replacement card in the fifth position of the first hand, the remaining blanks are filled in in all the hands, the value of the hands is determined and the player paid off.

Figure 4A:
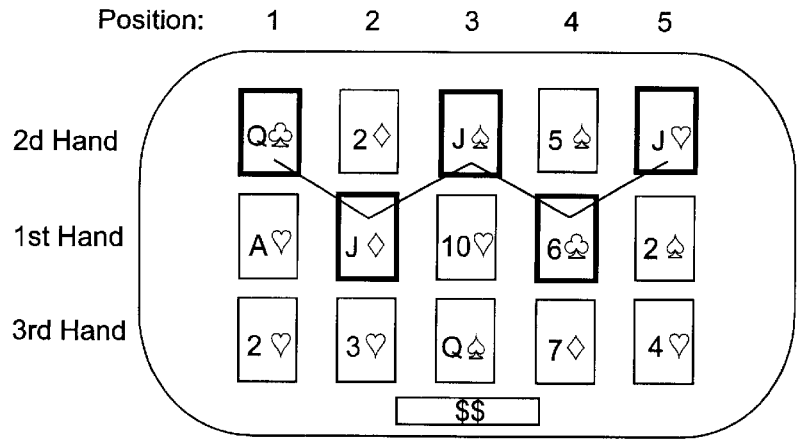
FIG. 4 shows the method of forming six additional secondary hands using the three-hand layout. Each continuous line designates a separate hand.

FIGS. 4A through 4F show how the game may be adapted to allow wagering on nine hands simultaneously. The regular three-hand layout is used as described with reference to FIG. 1, and played using either the shotgun or regular dealing method. The first, second and third hands (the "primary" hands) are then evaluated along with the secondary hands according to the patterns shown in FIGS. 4A–4F, with the lines showing the cards used to make up each hand. In addition to the three horizontal hands making up a hand each, six secondary hands are made up using the cards joined by each continuous line. Payoff is made based on all nine hands. In FIG. 4, the secondary hands are made up of the following combinations:

FIG. 4A: Combination 1: Second hand, positions 1, 3 and 5, First hand, positions 2 and 4.

Figure 4B:
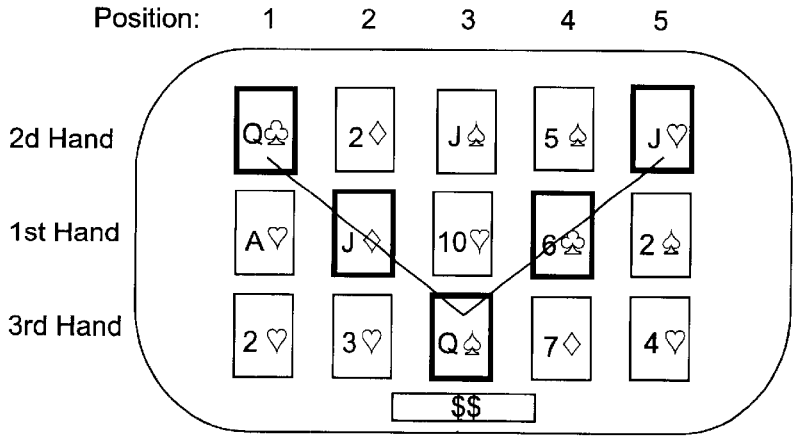
Figure 4C:
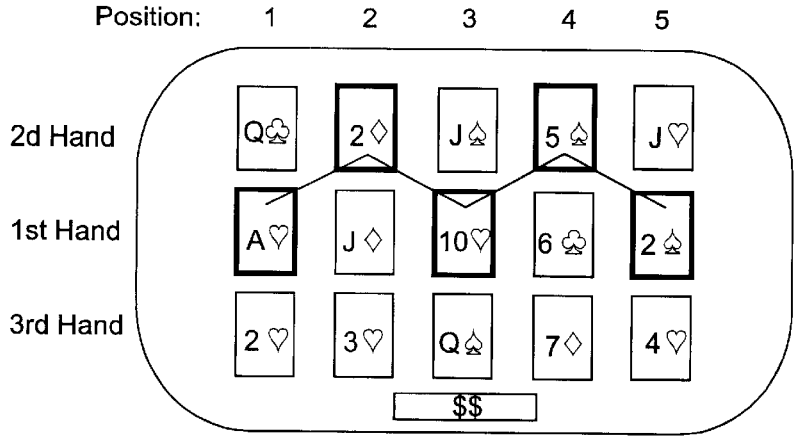
Figure 4D:
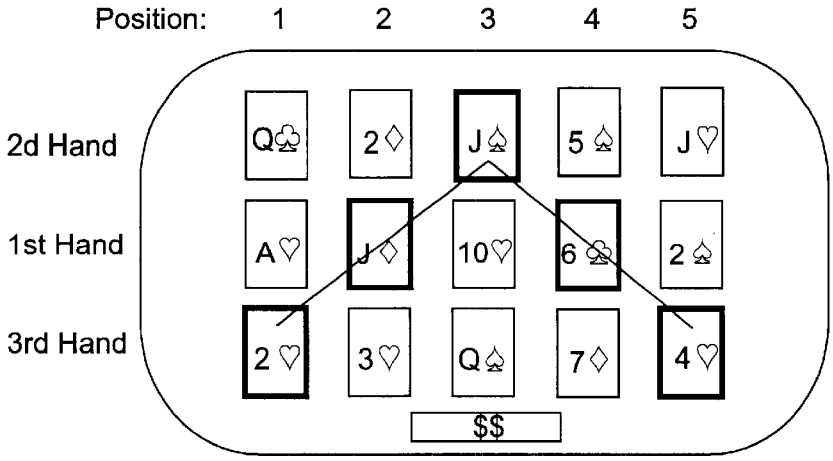

FIG. 4B: Combination 2: Second hand, positions 1 and 5, First hand, positions 2 and 4, third hand, position 3;

FIG. 4C. Combination 3: Second hand, positions 2 and 4, First hand, positions 1, 3 and 5;

FIG. 4D: Combination 4: Second hand, position 3, First hand, positions 2 and 4, Third hand, positions 1 and 5.

Figure 4E:
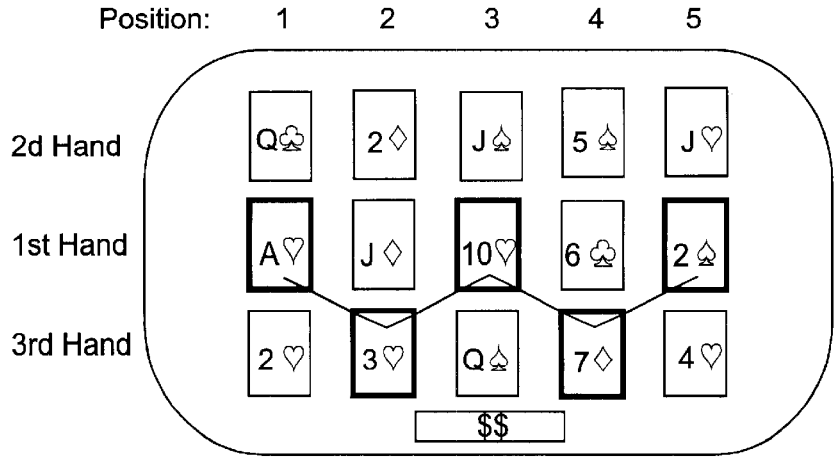
Figure 4F:
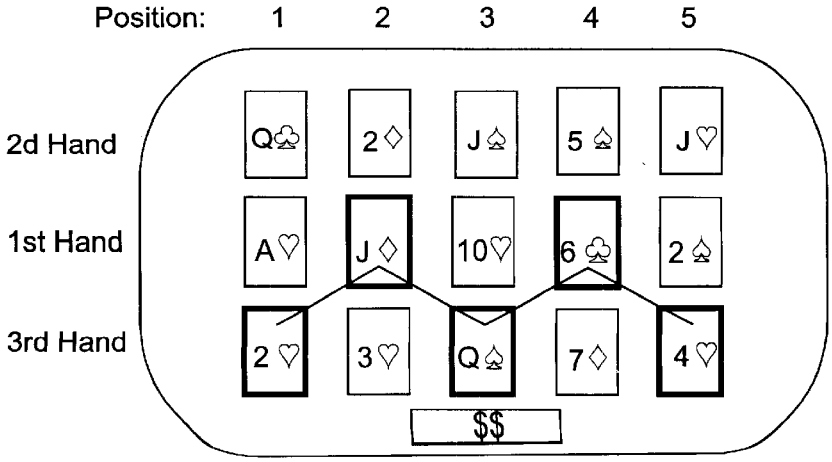

FIG. 4E: Combination 5: First hand, positions 1, 3 and 5, Third hand positions 2 and 4;

FIG. 4F: Combination 6: First hand, positions 2 and 4, Third hand, positions 1, 3 and 5.

The electronic poker game of this invention therefore comprises a display screen providing positions for placement of cards in a plurality of poker hands and a processor programmed to provide images of a poker hand layout comprising card images and vacant card positions operably connected to said display screen. The electronic game also comprises means for inputting into said electronic game a wager on each of, or on the aggregate of, said plurality of poker hands and means for storing the amount of said wager in memory in said processor. Such input means may include any means known to the art, including buttons, touch screen displays, and means for answering "yes" or "no" to questions programmed to appear on the screen. The processor also includes a randomizer, i.e. an algorithm for ordering card images randomly for presentation. Cards images corresponding to cards from only a single deck are used. The electronic game also comprises an initial deal activator, which may be any means known to the art for initiating play, preferably a programmed response within the processor responsive to input of said wager or other player signal known to the art to activate display of specific card images on said screen corresponding to dealing an initial three to seven cards sequentially into the first, second, third and optionally fourth and fifth positions of the first hand from said deck. The game includes input means as discussed above to allow the operator to provide signals to the processor corresponding to holding or moving each card dealt into the first hand into positions provided for one more additional five-card hands, and means for displaying the results of the signal on the screen, i.e., displaying the image of the moved or held card in the designated position. In response to an operator signal to move a card, a replacement deal program step in the processor immediately displays a card image on said screen corresponding to dealing a card from the randomized deck into the now vacant position in the first hand left by moving the card out of the first hand. The game also includes a completion deal program step in the processor capable of determining when all cards in the first hand have been held or have been moved into unfilled spaces in said additional hands and dealing cards from the randomized deck in a preset pattern to fill in all remaining available positions and complete the poker hands. The game device also comprises a calculator in the processor for determining the value of the poker hands and a display operably connected to the calculator to display a payoff amount.

In addition to displays showing the hands in play, the game may be programmed to display the amount wagered on each hand and the payoff figures at the end of each game. In one embodiment, the player inserts money or chips into the machine to initiate play, and the screen displays a running tally of the amount of money remaining. In addition, the game may be programmed to display by means of lights, flashing lights, or other suitable means, with or without accompanying sounds, when valuable poker hands such as a full house, two of a kind, etc. have been accomplished in any hand on the screen.

The payoffs can be set to provide bonus amounts for multiple payoff hands such as two straights or three flushes, and the like.

In an embodiment using a three-hand game, with an initial wager of three coins, the payoff amounts might be set as shown in Table 1.

TABLE 1

| 3 COINS | PAYS |
|---|---|
| Royal Flush | 1000 |
| Straight Flush | 50 |
| Four of a Kind | 25 |
| Full House | 9 |
| Flush | 6 |
| Straight | 4 |
| Three of a Kind | 3 |
| Two Pair | 2 |
| Pair of Jacks or better | 1 |

Table 2 provides exemplary payoff amounts for a three-hand game using an initial wager of six coins, and includes double bonus payoff amounts for having more than one of certain winning hands.

TABLE 2

| 6 COINS | PAYS | DOUBLE BONUS |
|---|---|---|
| Royal Flush | 2000 | 1000 |
| Straight Flush | 100 | 50 |
| Four of a Kind | 50 | 10 |
| Full House | 18 | 6 |
| Flush | 12 | 4 |
| Straight | 8 | |
| Three of a Kind | 6 | |
| Two Pair | 4 | |
| Pair of Jacks or better | 2 | |

Table 3 provides exemplary payoff amounts for a three-hand game using an initial wager of nine coins, and includes triple bonus payoff amounts for having three of certain winning hands.

TABLE 3

| 9 COINS | PAYS | TRIPLE BONUS |
|---|---|---|
| Royal Flush | 3000 | 2000 |
| Straight Flush | 150 | 100 |
| Four of a Kind | 75 | 50 |
| Full House | 27 | 30 |
| Flush | 18 | 20 |
| Straight | 12 | 10 |
| Three of a Kind | 9 | — |
| Two Pair | 6 | — |
| Pair of Jacks or better | 3 | |

Table 4 provides exemplary payoff amounts of a five-hand game using an initial wager of five coins.

TABLE 4

| 5 COINS | PAYS |
|---|---|
| Royal Flush | 1000 |
| Straight Flush | 50 |
| Four of a Kind | 25 |
| Full House | 9 |
| Flush | 6 |
| Straight | 4 |
| Three of a Kind | 3 |
| Two Pair | 2 |
| Pair of Jacks or better | 1 |

Table 5 provides exemplary payoff amounts for a five-hand game using an initial wager of ten coins, and includes double bonus payoff amounts for having more than one of certain winning hands.

TABLE 5

| 10 COINS | PAYS | DOUBLE BONUS |
|---|---|---|
| Royal Flush | 2000 | 1000 |
| Straight Flush | 100 | 50 |
| Four of a Kind | 50 | 10 |
| Full House | 18 | 6 |
| Flush | 12 | 4 |
| Straight | 8 | 2 |
| Three of a Kind | 6 | — |
| Two Pair | 4 | — |
| Pair of Jacks or better | 2 | — |

Table 6 provides exemplary payoff amounts for a five-hand game using an initial wager of fifteen coins, and includes triple bonus payoff amounts for having three of certain winning hands.

TABLE 6

| 15 COINS | PAYS | TRIPLE BONUS |
|---|---|---|
| Royal Flush | 3000 | 2000 |
| Straight Flush | 150 | 100 |
| Four of a Kind | 75 | 50 |
| Full House | 27 | 30 |
| Flush | 18 | 20 |
| Straight | 12 | 10 |
| Three of a Kind | 9 | |
| Two Pair | 6 | |
| Pair of Jacks or better | 3 | |

Table 7 provides exemplary payoff amounts for a five-hand game using an initial wager of twenty coins, and includes quadruple bonus payoff amounts for having four of certain winning hands.

TABLE 7

| 20 COINS | PAYS | QUADRUPLE BONUS |
|---|---|---|
| Royal Flush | 4000 | 6000 |
| Straight Flush | 200 | 500 |
| Four of a Kind | 100 | 200 |
| Full House | 36 | 100 |
| Flush | 24 | 50 |
| Straight | 16 | 30 |
| Three of a Kind | 12 | — |
| Two Pair | 8 | — |
| Pair of Jacks or better | 4 | — |

Table 8 provides exemplary payoff amounts for a five-hand game using an initial wager of twenty-five coins, and includes quintuple bonus payoff amounts for having five of certain winning hands.

TABLE 8

| 25 COINS | PAYS | 5-WAY BONUS |
|---|---|---|
| Royal Flush | 5000 | 10000 |
| Straight Flush | 250 | 1000 |
| Four of a Kind | 125 | 500 |
| Full House | 42 | 100 |
| Flush | 30 | 50 |
| Straight | 20 | — |
| Three of a Kind | 15 | — |
| Two Pair | 10 | — |
| Pair of Jacks or better | 5 | — |

Table 9 provides exemplary payoff amounts for a nine-hand game (using three primary and six secondary hands as shown in FIGS. 4A–4F) and an initial wager of nine coins.

TABLE 9

| 9 COINS | PAYS |
|---|---|
| Royal Flush | 1000 |
| Straight Flush | 50 |
| Four of a Kind | 25 |
| Full House | 9 |
| Flush | 6 |
| Straight | 4 |
| Three of a Kind | 3 |
| Two Pair | 2 |
| Pair of Jacks or better | 1 |

Table 10 provides exemplary payoff amounts for a nine-hand game and an initial wager of 18 coins with double bonus payoff amounts for having two of certain winning hands.

TABLE 10

| 18 COINS | PAYS | DOUBLE BONUS |
|---|---|---|
| Royal Flush | 2000 | 1000 |
| Straight Flush | 100 | 50 |
| Four of a Kind | 50 | 10 |
| Full House | 18 | 6 |
| Flush | 12 | 4 |
| Straight | 8 | — |
| Three of a Kind | 6 | — |
| Two Pair | 4 | — |
| Pair of Jacks or better | 2 | — |

Table 11 provides exemplary payoff amounts for a nine-hand game and an initial wager of 27 coins having triple bonus payoffs for having three of certain hands.

TABLE 11

| 27 COINS | PAYS | TRIPLE BONUS |
|---|---|---|
| Royal Flush | 3000 | 2000 |
| Straight Flush | 150 | 100 |
| Four of a Kind | 75 | 50 |
| Full House | 27 | 30 |
| Flush | 18 | 20 |
| Straight | 12 | 10 |
| Three of a Kind | 9 | — |
| Two Pair | 6 | — |
| Pair of Jacks or better | 3 | — |

The poker game and game device of this invention has been illustrated by specific embodiments, however as will be apparent to those of skill in the art, equivalent means for carrying out the invention, and equivalent method steps may be provided within the scope of the claims hereof.

What is claimed is:

1. A method of playing a poker game comprising:

(a) providing positions for placement of cards in a plurality of poker hands;

(b) placing a wager on each poker hand or on the aggregate of said plurality of poker hands;

(c) randomizing a card deck;

(d) dealing an initial three to seven cards into a first hand from said randomized deck;

(e) holding or discarding cards dealt into said first hand, and moving discarded cards into positions provided for one more additional five-card hands;

(f) dealing from said randomized deck an immediate replacement card into said first hand for each card moved;

(g) when all cards in said first hand have been held or have been moved into unfilled spaces in said additional hands, dealing cards from said randomized deck in a preset pattern to fill in all remaining available positions and complete said poker hands;

(h) determining the value of each poker hand;

(i) paying to or receiving from the player the value of each poker hand in accordance with predetermined payoff amounts.

2. The method of claim 1 played using an electronic game machine providing card images.

3. The method of claim 1 played using three hands.

4. The method of claim 1 played using five hands.

5. The method of claim 1 wherein five cards are initially dealt.

6. The method of claim 1 wherein three cards are initially dealt.

7. The method of claim 1 comprising also determining the poker hand value of secondary hands formed of selected combinations of cards in said plurality of hands and paying or receiving from the player values calculated from said secondary hands.

8. The method of claim 1 wherein said hands are dealt using a 52-card deck.

9. The method of claim 1 wherein said hands are dealt using a 52-card deck plus two wild cards.

10. A method of playing a card game comprising:

(a) providing positions for placement of at least three poker hands of five cards each, a first hand, a second hand, and a third hand, an optional fourth hand, and an optional fifth hand;

(b) making a wager on the value of said poker hands;

(c) initially dealing at least three cards of the first hand from a single deck into at least the first three positions of said first hand;

(d) holding the card dealt into the first position of the first hand or moving it to the first position of the second, third, or subsequent hand;

(e) if a card is moved from the first position of the first hand, dealing from said deck a replacement card into the vacant position left by its removal;

(f) repeating steps (d)–(e) until the vacant first positions of all hands have been filled or until the card in the first position of the first hand has been held;

(g) repeating steps (d)–(f) for the second positions of each hand;

(h) repeating steps (d)–(f) for the third positions of each hand;

(i) dealing a card from said deck into the fourth position of the first hand if it is vacant and repeating steps (d)–(f) for the fourth positions of each hand;

(j) dealing a card from said deck into the fifth position of the first hand if it is vacant and repeating steps (d)–(f) for the fifth positions of each hand;

(k) dealing cards from said deck into the remaining vacant positions of said first, second, third and optional hands;

(l) determining the poker hand ranking of the resulting hands;

(m) paying or deducting from a player's account a preset amount determined by said poker hand rankings.

11. The method of claim 10 in which three cards of said first hand are initially dealt in step (c), and in steps (i) and (j) cards are dealt into vacant fourth and fifth positions of the first hand.

12. The method of claim 10 in which five cards of said first hand are initially dealt in step (c) and in steps (i) and (j) cards are not dealt into the fourth and fifth positions of the first hand.

13. The method of claim 10 in which positions are provided for five poker hands.

14. The method of claim 10 in which optional poker hands are compiled using cards in preselected positions of said hands.

15. The method of claim 10 in which positions are provided for three hands of five cards each, and said optional hands are made up of one or more combinations of preselected positions selected from the group consisting of:

Combination 1: Second hand, positions 1, 3 and 5, First hand, positions 2 and 4;

Combination 2: Second hand, positions 1 and 5, First hand, positions 2 and 4, third hand, position 3;

Combination 3: Second hand, positions 2 and 4, First hand, positions 1, 3 and 5;

Combination 4: Second hand, position 3, First hand, positions 2 and 4, Third hand, positions 1 and 5;

Combination 5: First hand, positions 1, 3 and 5, Third hand positions 2 and 4; and Combination 6: First hand, positions 2 and 4, Third hand, positions 1, 3 and 5.

16. The method of claim 10 in which all cards are dealt from a 52-card deck.

17. The method of claim 10 in which all cards are dealt from a 52-card deck plus two wild cards.

18. The method of claim 10 wherein said positions and cards are in the form of images on the screen of an electronic game device.

19. An electronic game comprising:

(a) a display screen providing positions for placement of cards in a plurality of poker hands;

(b) a processor programmed to provide images of a poker hand layout comprising vacant card positions and card images operably connected to said display screen;

(c) input means for inputting into said processor a start signal and/or a wager on each of or on the aggregate of said plurality of poker hands and storing the amount of any wager in memory in said processor;

(d) a randomizer in said processor for randomizing the order of presentation to said screen of images corresponding to cards from a single card deck;

(e) an initial deal activator responsive to input of said wager or start signal to activate display of specific card images on said screen corresponding to dealing an initial three to seven cards into a first hand from said deck;

(f) input means for providing operator signals to said processor corresponding to holding or discarding each card dealt into said first hand and moving the discarded card into a position provided for cards of one or more additional five-card hands, and display means operably connected thereto for displaying the results of said signals on said screen;

(g) replacement deal means in said processor responsive to said operator signals for immediately displaying a card image on said screen corresponding to dealing from said randomized deck a replacement card into said first hand for each card moved from said first hand;

(h) completion deal means in said processor capable of determining when all cards in said first hand have been held or have been moved into unfilled spaces in said additional hands, comprising a completion deal algorithm for dealing cards from said randomized deck in a preset pattern to fill in all remaining available positions and complete said poker hands;

(i) a calculator in said processor for determining the value of the poker hands; and (j) a display operably connected to said calculator to display a payoff amount.

20. The electronic game of claim 19 comprising means in said processor for adjusting the payoff amounts and displays thereof.

* * * * *

UNITED STATES PATENT AND TRADEMARK OFFICE

CERTIFICATE OF CORRECTION

PATENT NO. : 6,270,405 B1
DATED : August 7, 2001
INVENTOR(S) : Ferguson

It is certified that error appears in the above-identified patent and that said Letters Patent is hereby corrected as shown below:

Column 3,
Line 43, please replace "tree" with -- three --.
Line 45, between "one" and "more" please insert -- or --.

Column 5,
Line 23, please replace "payer" with -- player --.

Column 6,
Line 12, please replace "show" with -- shows --.
Line 30, please replace "band" with -- hand --.

Column 7,
Line 34, please replace "lowernumbered" with -- lower-numbered --.

Column 13,
Line 15, between "one" and "more" please insert -- or --.

Signed and Sealed this

Second Day of April, 2002

*Attest:*

*Attesting Officer*

JAMES E. ROGAN
*Director of the United States Patent and Trademark Office*